US006592196B2

(12) United States Patent
Akiyama et al.

(10) Patent No.: US 6,592,196 B2
(45) Date of Patent: Jul. 15, 2003

(54) DRIVE METHOD FOR INK JET HEAD

(75) Inventors: Yoshitaka Akiyama, Hitachinaka (JP); Nobuhiro Noto, Hitachinaka (JP); Yutaka Shoji, Hitachinaka (JP); Hiroshi Takahagi, Hitachinaka (JP); Osamu Machida, Hitachinaka (JP); Yoshinari Suzuki, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 09/986,734

(22) Filed: Nov. 9, 2001

(65) Prior Publication Data

US 2002/0057304 A1 May 16, 2002

(30) Foreign Application Priority Data

Nov. 10, 2000 (JP) ..... 2000-343370

(51) Int. Cl.[7] ..... B41J 29/38; B41J 2/195
(52) U.S. Cl. ..... 347/10; 347/7; 347/14
(58) Field of Search ..... 347/10, 7, 14

(56) References Cited

U.S. PATENT DOCUMENTS 5,179,389 A * 1/1993 Arai et al. ..... 347/7
6,102,512 A * 8/2000 Torii et al. ..... 347/10

FOREIGN PATENT DOCUMENTS

JP HEI-1-115638 5/1989 ..... B41J/3/04
JP HEI-9-300613 11/1997 ..... B41J/2/045

* cited by examiner

*Primary Examiner*—Anh T.N. Vo
*Assistant Examiner*—Alfred E. Dudding
(74) *Attorney, Agent, or Firm*—Whitham, Curtis & Christofferson, P.C.

(57) ABSTRACT

An appropriate pulse width of a driving pulse for driving a piezoelectric element of ink jet head is determined by using the head difference. That is, the pulse width with which the least change in the ink speed occurs can be used as the pulse width of the driving signal for the piezoelectric actuator. As a result, a reliable ink jet printer head capable of stably ejecting ink droplets over a long period of time and having excellent frequency characteristics can be provided.

12 Claims, 6 Drawing Sheets

DRIVE METHOD FOR INK JET HEAD

BACKGROUND OF THE INVENTION

1. Field of the Invention

The present invention relates to an ink jet head of an ink jet printer including a piezoelectric actuator for applying pressure to ink so as to eject ink droplets onto a recording medium.

2. Related Art

There have been provided thermal type ink jet heads and piezoelectric type ink jet heads, both eject ink droplets from nozzles to form an ink image on a recording medium. The thermal type heads eject ink droplets by an electric heater that generates air bubbles in ink. Because the thermal type heads are produced by a photolithography technology, the nozzle pitch can be as small as less than 100 $\mu$m. However, the driving frequency at continuous ink ejection is limited to 10 kHz or less. Also, the life of the heads is as short as several hundred million times of ejection.

On the other hand, the piezoelectric type heads include piezoelectric elements and vibration plates provided in the pressure chamber. When the piezoelectric element deforms, the vibration plate vibrates and applies pressure to ink in a pressure chamber, and so an ink droplet is ejected. Because the deforming amount of the piezoelectric element is relatively small, the vibration plate needs to have a large surface area. This increases a nozzle pitch to about 100 $\mu$m. However, because the driving frequency depends on the shape of the piezoelectric elements, the driving frequency can be achieved higher than that of the thermal type heads, and so the piezoelectric type heads are well suited for high speed printing. Also, the piezoelectric heads can be used to eject any type of ink in contrast to the thermal type heads.

An example of the piezoelectric type ink jet head will be described while referring to FIG. 2.

As shown in FIG. 2, a head includes a piezoelectric element 14 fixed to a housing 19, a ceramic member 16 attached to a side of the piezoelectric element 14, and a chamber plate 4 formed with a plurality of pressure chambers 3 (only one is shown in FIG. 2) by etching a stainless material, and an orifice plate 2 formed with a plurality of orifices 1. The piezoelectric element 14 has a vibration surface confronting an ink inlet opening of the orifice 1 via the pressure chamber 3. The orifice 1 and the pressure chamber 3 together define a nozzle. A printer having this type of head is disclosed in Japanese Patent-Application Publication No. HEI-1-115638, for example.

In this type of head, for forming an ink image on a recording medium, ink droplets are continuously ejected from nozzles. However, when the driving frequency is high or when the ejection is performed over a long period of time, there is a possibility that some of the nozzles become defective. In order to prevent such defective nozzle, Japanese Patent-Application Publication No. HEI-9-300613 proposes to drive the piezoelectric elements by a driving signal having a pulse width in a range from 60% to 100% of Helmholtz resonant frequency.

SUMMARY OF THE INVENTION

However, because the etching technique is insufficiently precise, the pressure chambers formed in the chamber plate will have uneven shapes and volumes, and the uneven volumes vary the Helmholtz resonant frequencies by relatively large value among the plurality of nozzles. This makes difficult to determine an appropriate pulse width.

It is an object of the present invention to overcome the above problems and also to provide a drive method for an ink jet head to perform ink ejection in a stabled manner over a long period of time.

In order to achieve the above and other objectives, there is provided a drive method for an ink jet head including an ink chamber defined by a diaphragm and connected to an ink tank storing ink, an orifice plate formed with at least one line of plurality of orifices therein, a piezoelectric element which is attached to the diaphragm and deforms when a drive pulse is applied to the piezoelectric element, thereby varying pressure in the ink chamber, an ink channel for supplying ink to the ink chamber, and a housing formed with a common ink channel in fluid communication with the ink channel, the driving method comprising the steps of determining a pulse width, with which an ink speed changes by a small amount when a head difference between a vertical position of the orifice and a vertical position of the head of the ink in the ink tank is changed, and applying a drive signal having the determined pulse width to the piezoelectric actuator.

BRIEF DESCRIPTION OF THE DRAWINGS

In the drawings:

FIG. 9(*b*) shows another example of driving waveform; and

FIG. 9(*c*) shows still another example of driving waveform.

PREFERRED EMBODIMENT OF THE PRESENT INVENTION

Next, an ink jet head according to an embodiment of the present invention will be described while referring to the accompanying drawings.

Figure 1:
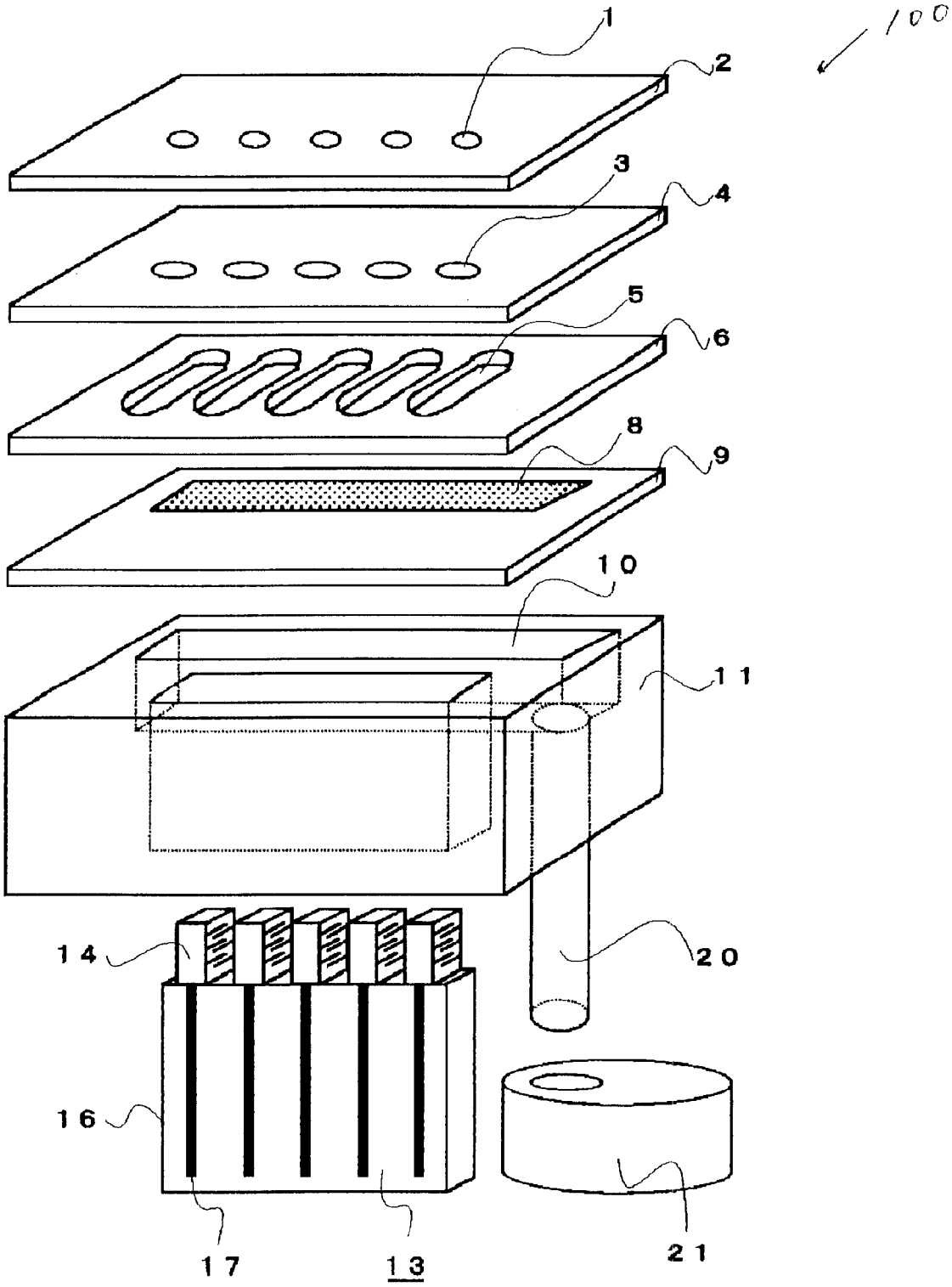
FIG. 1 is a perspective view of main components of an ink jet head according to an embodiment of the present invention.
Figure 2:
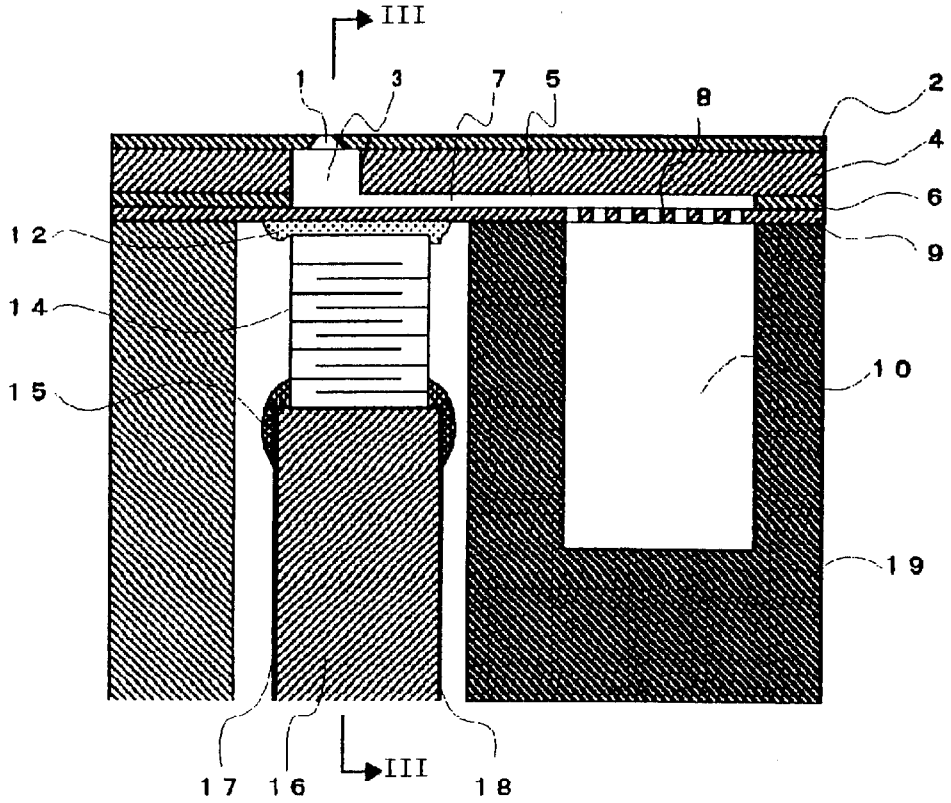
FIG. 2 is a cross-sectional view of the ink jet head.
Figure 3:
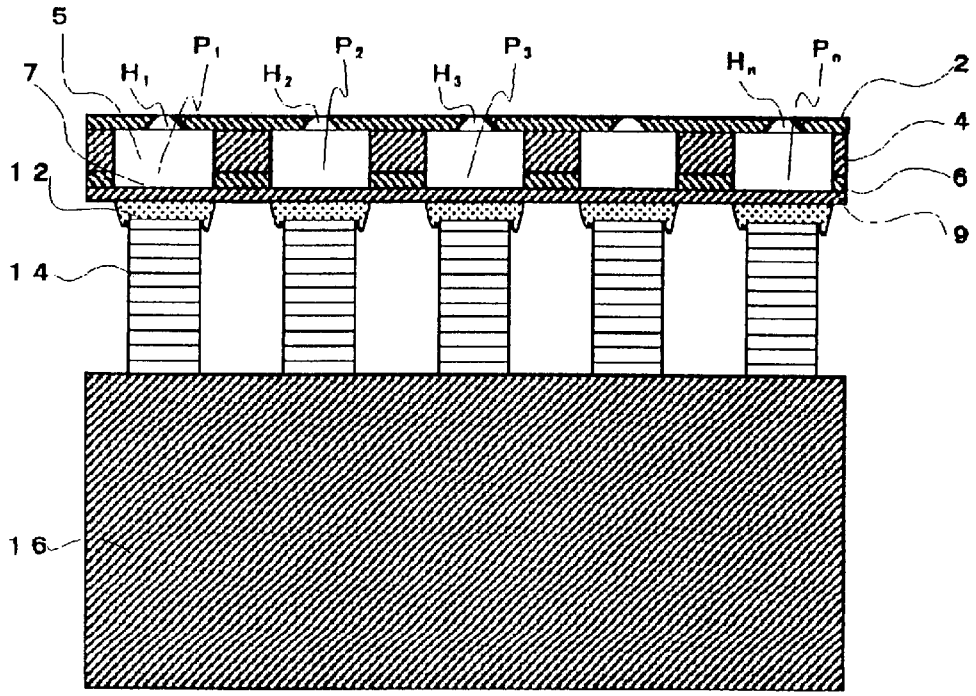
FIG. 3 is a cross-sectional view taken along a line III—III of FIG. 2.

First, overall configuration of an ink jet head 100 will be described. As shown in FIGS. 1 through 3, the ink jet head 100 includes an orifice plate 2, a chamber plate 4, a restrictor plate 6, a diaphragm plate 9, and a housing 11, all are stacked and fixed one on the other.

The chamber plate 4, the restrictor plate 6, and the diaphragm plate 9 are formed by etching the stainless material or electroforming the nickel material. The housing 11 is produced by cutting the stainless material. The ink jet head 100 also includes a piezoelectric actuator 13. The housing 11 is connected to an ink tank 21 via an ink introducing pipe 20.

The orifice plate 2 is formed with a plurality of orifices 1, which include orifices H1, H2, H3, . . . Hn arranged in a nozzle line at a pitch of 1/37.5 inch, i.e., 677 μm. The forming accuracy of the orifices 1 greatly affects the ink ejection performance of the ink jet head 100. Therefore, in order to suppress the unevenness in the orifices' shape, the orifice plate 2 is produced by a highly precise technology, such as accurate pressing of stainless, laser processing, or electroforming processing of nickel.

The chamber plate 4 is formed with a plurality of pressure chambers 3, which include pressure chambers P1, P2, P3, . . . Pn. The orifices H1, H2, H3, . . . Hn and the pressure chambers P1, P2, P3, . . . Pn together define a plurality of nozzles.

The restrictor plate 6 is formed with a plurality of restrictors 5. The diaphragm plate 9 is provided with a filter 8 and a vibration plate 7 (FIG. 2). The housing 11 is formed with a common ink channel 10. Ink within the common ink channel 10 is supplied to the respective pressure chambers 3 via the filter 8 and the respective restrictors 5, and is ejected as ink droplets through the orifices 1. The filter 8 removes any debris from the ink and prevents the debris from reaching the orifices 1. The restrictors 5 restrict the amount of ink supplied into the pressure chambers 3. The vibration plate 7 effectively transmits the pressure generated at the piezoelectric actuator 13 to the pressure chambers 3 in a manner described later.

The ink introducing pipe 20 is connected to the housing 11 for introducing ink from the ink tank 21 to the common ink channel 10.

The piezoelectric actuator 13 is attached to the housing 11. The piezoelectric actuator 13 includes a plurality of stacked piezoelectric elements 14 and a supporting plate 16 for supporting the piezoelectric elements 14. The piezoelectric actuator 13 is produced in the following manner.

First, a plurality of stacked piezoelectric elements in a rod like shape are arranged and fixed onto the supporting plate 16. Then, each of the stacked piezoelectric elements is cut and divided into a plurality of piezoelectric elements 14 by using a dicing saw or a wire saw such that each piezoelectric element 14 corresponds to one of the pressure chambers 3.

As shown in FIGS. 1 and 2, the supporting plate 16 is provided with common electrodes 18 and individual electrodes 17 for transmitting electric driving signals from an external driving circuit (not shown) to the corresponding piezoelectric elements 14.

As shown in FIG. 2, each piezoelectric element 14 is attached to the vibration plate 7 by a resilient material 12. With this configuration, when the electric signal from the external driving circuit is applied to the piezoelectric element 14, the piezoelectric element 14 deforms toward the orifice 1. Because the piezoelectric elements 14 is adhered on the supporting plate 16 having high stiffness, this deforms the vibration plate 7 via the resilient material 12 and increases the internal pressure of the pressure chambers 3. As a result, the ink in the pressure chamber 3 is ejected as an ink droplet through the orifice 1.

When ejecting ink from some of the nozzles, crosstalk occurs, which undesirably affects ink ejection from adjacent nozzles. The crosstalk occurs because of the following reasons. That is, vibration due to deformation of the piezoelectric element 14 at the time of ink ejection is transmitted to adjacent piezoelectric elements 14 via the orifice plate 2, the diaphragm plate 9, the housing 11, and the supporting plate 16, and thus transmitted vibration affects the deformation of the adjacent piezoelectric elements 14. The pressure vibration in ink within the pressure chamber 3 is also transmitted to the adjacent pressure chambers 3 via the common ink channel 10 which connects therebetween, and thus transmitted vibration affects ink ejection performance at the adjacent pressure chambers 3.

Moreover, the influence of the crosstalk may cause complex vibration waveforms overlapping within the pressure chamber 3, resulting in introducing air into the pressure chamber 3 through the orifice 1. Such air will form an air bubble and remain within the pressure chamber 3. When the amount of the air bubbles increases, the internal pressure change of the pressure chambers 3 is absorbed by the air bubbles when the piezoelectric elements 14 deforms, so that the ink ejection may be failed for insufficient pressure.

Figure 4:
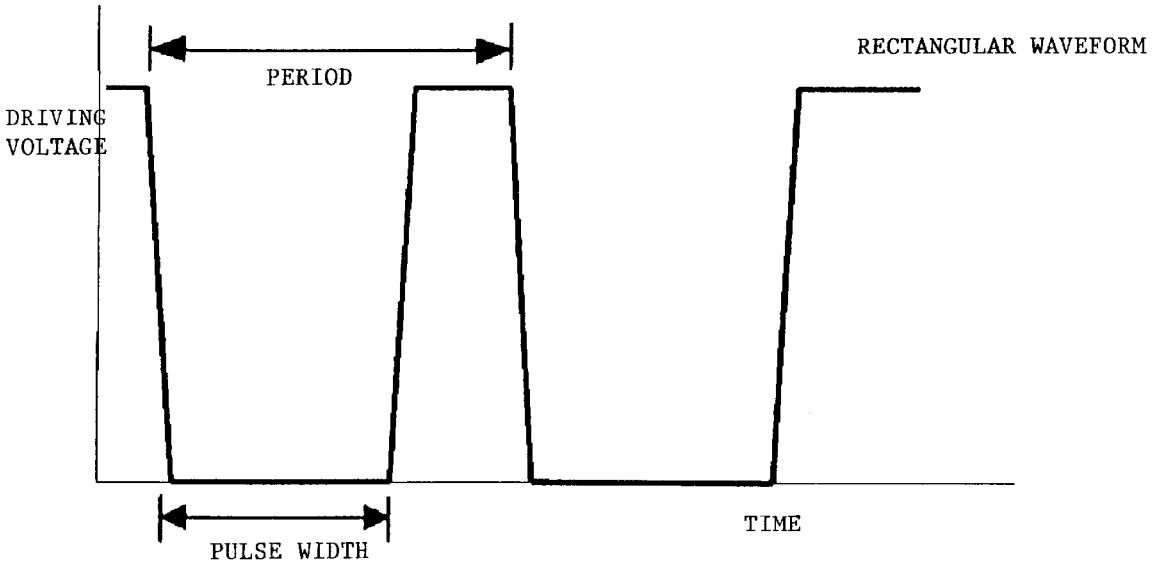
FIG. 4 is a rectangular driving waveform for driving the ink jet head.

Such problems can be prevented by selecting an optimum driving waveform capable of suppressing the influence of the transmitted vibrations. It should be noted that the driving waveform of the present embodiment is a rectangular waveform as shown in FIG. 4. The optimum driving waveform can be selected by the following manner.

Figure 5:
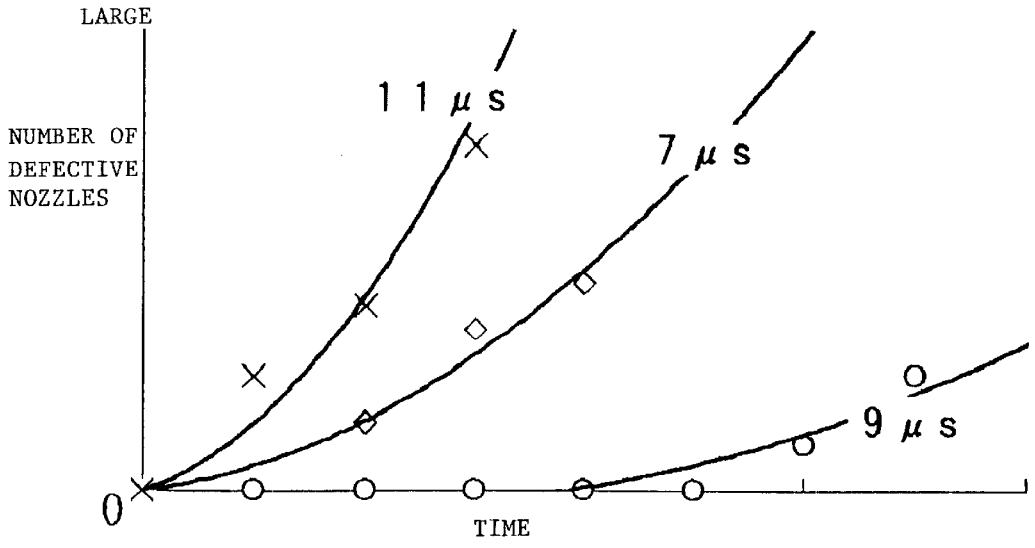
FIG. 5 is a graph showing relationship between the time and the number of defective nozzles.

First, stability of the ink ejection is determined. For this purpose, continuous ink ejection is performed from all the nozzles by applying a rectangular driving waveform with a pulse width of 7 μs, 9 μs, and 11 μs at the frequency of 20 kHz. The relationship between the time and the number of nozzles that became defective during the continuous ink ejection is shown in FIG. 5. As will be understood from FIG. 5, when the pulse width is 9 μs, the number of the defective nozzles is the smallest.

Figure 6:
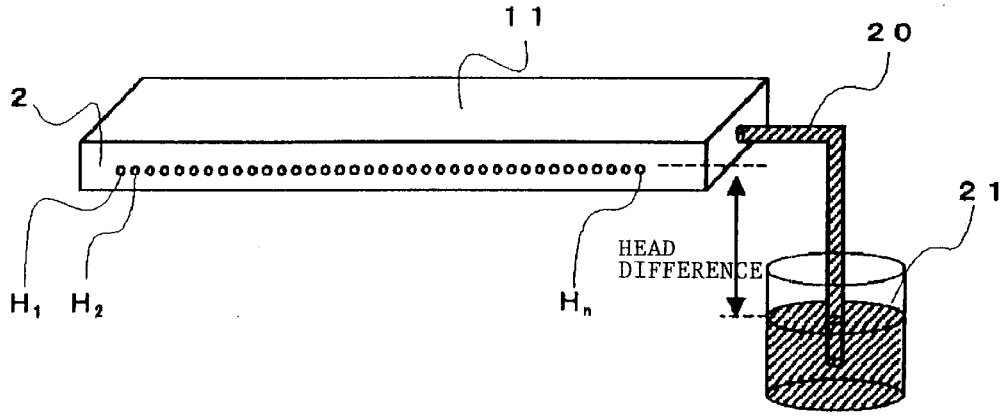
FIG. 6 is an explanatory view of head difference between orifices and the head of ink.

Next, the flying speeds of ink droplets (hereinafter referred to as "ink speed") are measured. As shown in FIG. 6, ink is ejected in the horizontal direction in the present embodiment.

Figure 7:
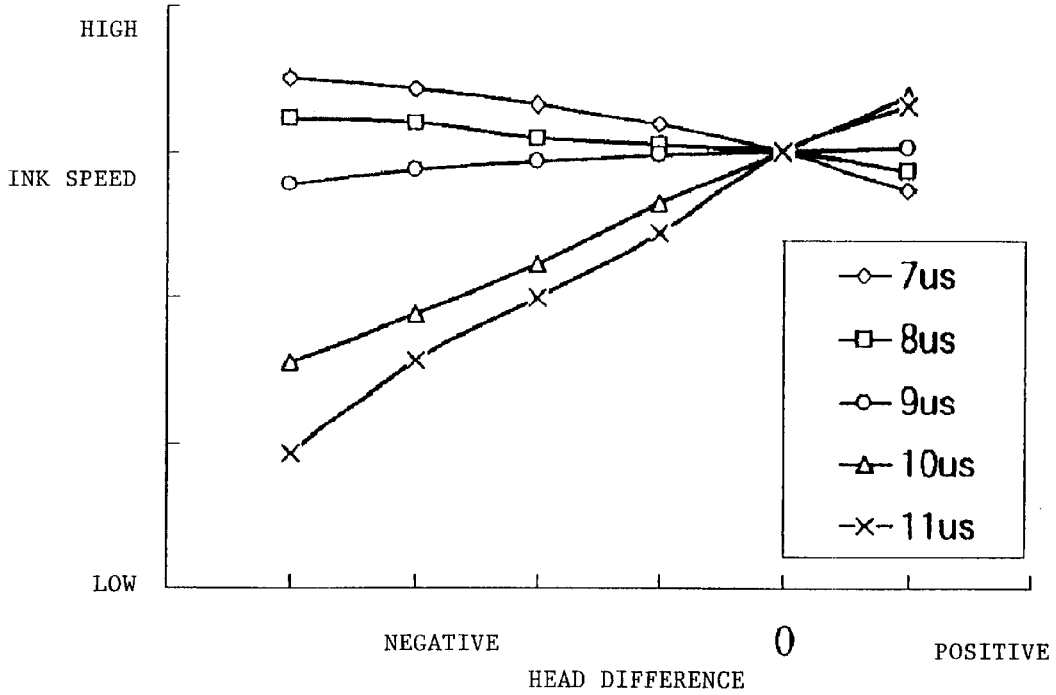
FIG. 7 is a graph showing relationship between the head difference and the ink speed.

Specifically, for each driving signal having the pulse width of 7 μs, 9 μs, 11 μs, a driving voltage required to achieve a predetermined ink speed when the head difference is 0 is determined, the head difference indicating the difference between the vertical position of the orifices H1, H2, H3 . . . Hn and the vertical position of the head of the ink within the ink tank 21. Then, ink speed is measured while changing a head difference in order to change the pressure applied to the ink within the nozzles. The results are shown in FIG. 7. In FIG. 7, "positive" in the horizontal axis indicates that the orifices 1 are positioned higher than the head of the ink, and "negative" indicates that the orifices 1 are positioned lower than the head of the ink.

As shown in FIG. 7, the change in the ink speed due to change in the head difference is relatively small for a certain pulse width, 9 μs in this example. This means that the driving signal with the certain pulse width is less likely affected by the pressure change in the nozzles due to the change in the head difference. The certain pulse width is 9 μs, with which the smallest number of nozzles have became defective as described above.

Although the ink is ejected in the horizontal direction in the present example, the ejection direction is irrelevant. The same result has been obtained regardless of the ink ejection direction. Also, although in the present example, the head difference is changed, same result can be obtained when the internal pressure of the ink tank 21 is changed.

Next, a driving voltage is set to achieve a predetermined ink speed at the frequency of 2 kHz for each of the driving signal. Then, the frequency is increased to 20 kHz while maintaining the driving voltage. The result is shown in FIG. 8.

Figure 8:
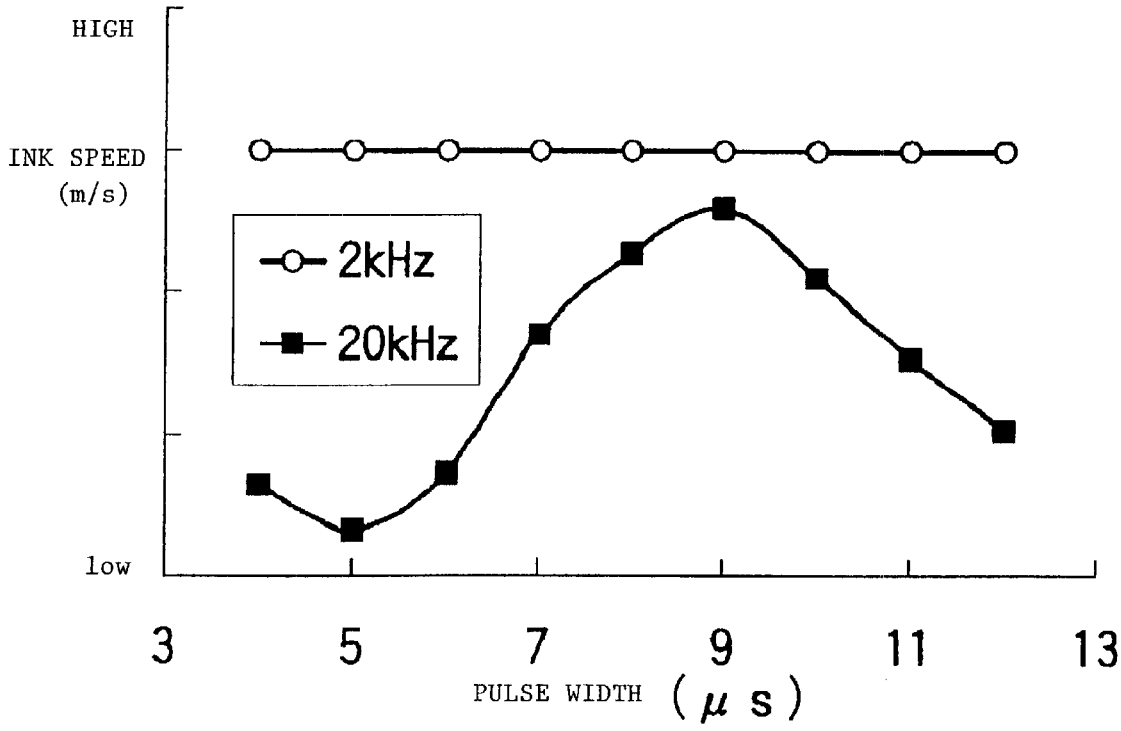
FIG. 8 is a graph showing relationship between pulse width and the ink speed.

As shown in FIG. 8, when the frequency is changed from 2 kHz to 20 kHz, the change in ink speed is small for a certain pulse width, that is, 9 μs in this example. That is, the certain pulse width is least affected by the pressure change due to the change in the driving frequency.

The certain pulse width is 9 μs again. Needless to say, it is preferable that the ink speed be maintained constant regardless of the change in driving frequency in the term of printing quality.

As described above, a pulse width of a driving pulse suitable for suppressing influence of pressure fluctuation within the pressure chamber can be determined to be a pulse width which causes less change in the ink speed even when the head difference and the driving frequency are changed. Thus determined pulse width realizes stable ink ejection with excellent frequency characteristic over a long period of time while suppressing influence of the crosstalk. In this way, reliability of the ink jet head is enhanced.

It is preferable that the pulse width that causes less change in the ink speed when the head difference is changed is equal to the pulse width that causes less change in the ink speed when the driving frequency is changed in a manner described above. However, when these two do not match, a pulse width close to these pulse widths can be used. For example, any pulse width between the two pulse widths can be used.

As described above, according to the present invention, an appropriate pulse width which regulates influence from the pressure change in the pressure chamber due to crosstalk can be determined by using the head difference. That is, the pulse width with which the least change in the ink speed occurs can be used as the pulse width of the driving signal for the piezoelectric actuator. As a result, a reliable ink jet printer head capable of stably ejecting ink droplets over a long period of time and having excellent frequency characteristics can be provided.

While some exemplary embodiments of this invention have been described in detail, those skilled in the art will recognize that there are many possible modifications and variations which may be made in these exemplary embodiments while yet retaining many of the novel features and advantages of the invention.

Figure 9A:
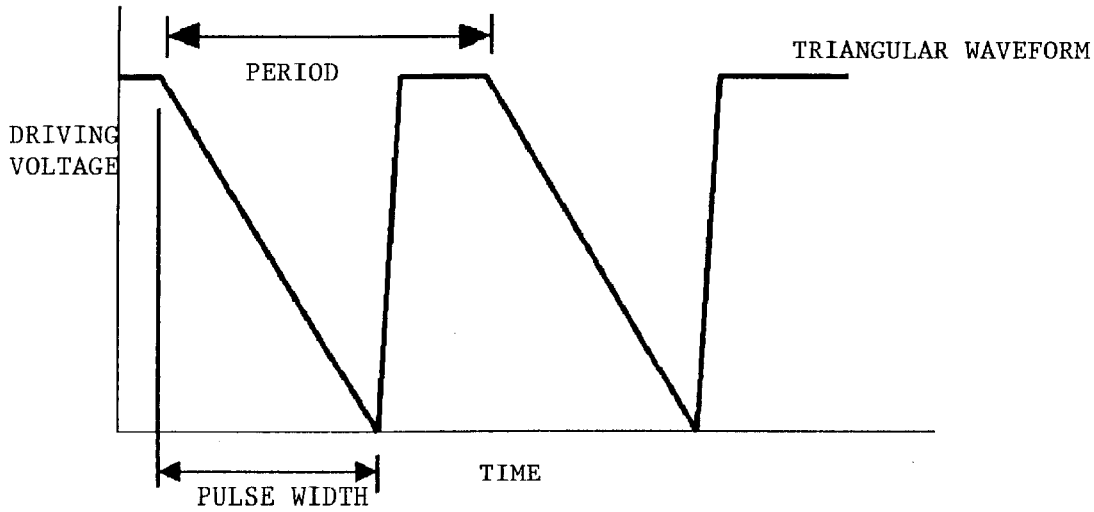
FIG. 9(*a*) shows an example of driving waveform.
Figure 9B:
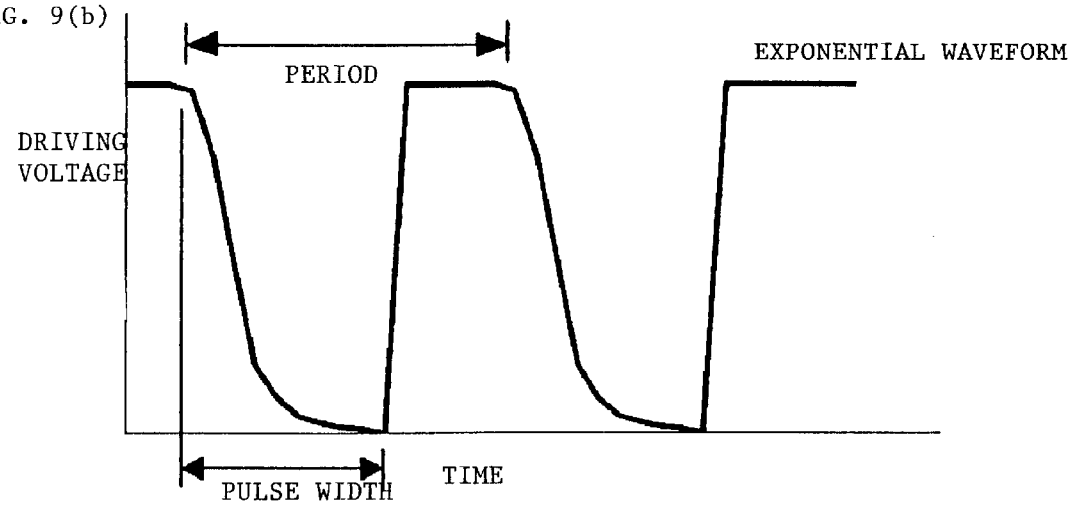
Figure 9C:
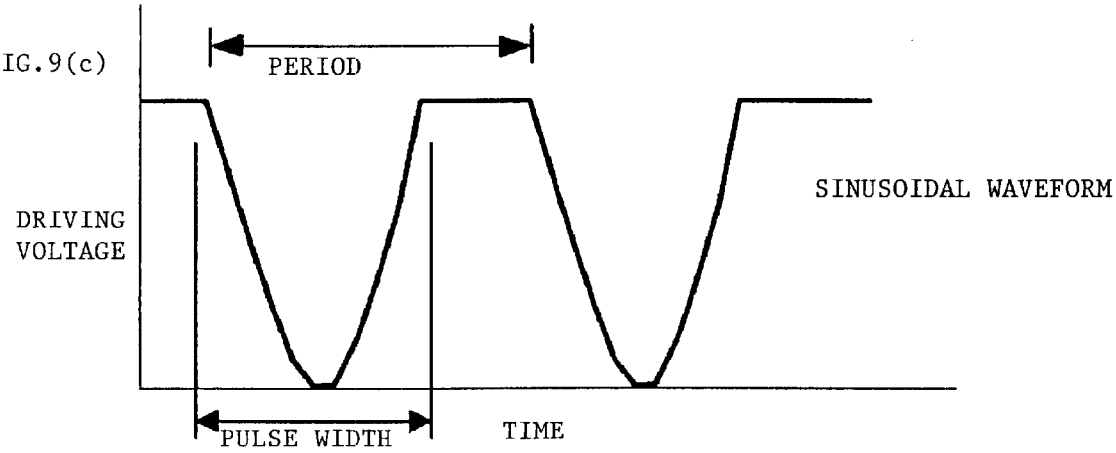

For example, although in the above example, the rectangular waveform is used, triangular waveform shown in FIG. 9(*a*), exponential waveform shown in FIG. 9(*b*), sinusoidal wave shown in FIG. 9(*c*), or the like can be used instead.

Although the orifices 1 are formed in the orifice plate 2 at a pitch of 1/37.5 inch, i.e., 677 μm in the above-described embodiment, there is no limitation in the number of nozzles 1, as well as a number of nozzle line and a configuration of ink jet head 100.

What is claimed is:

1. A driving method for an ink jet head including an ink chamber defined by a diaphragm and connected to an ink tank storing ink, an orifice plate formed with at least one line of a plurality of orifices therein, a piezoelectric element which is attached to the diaphragm and deforms when a drive pulse is applied to the piezoelectric element, thereby varying pressure in the ink chamber, an ink channel for supplying ink to the ink chamber, and a housing formed with a common ink channel in fluid communication with the ink channel, the driving method comprising the steps of:

applying a drive signal to the piezoelectric actuator to eject an ink droplet, the drive signal having a predetermined pulse width, wherein an ink speed of the ink droplet ejected in response to the drive signal having the predetermined pulse width changes by a small amount when a head difference between a vertical position of the orifice and a vertical position of the head of the ink in the ink tank is changed, wherein the same drive signal is applied to the piezoelectric actuator before and after the head difference changes.

2. The driving method according to claim 1, wherein the ink speed of the ink droplet ejected in response to the drive signal having the predetermined pulse width changes by a small amount when a driving frequency is changed.

3. The driving method according to claim 2, wherein the predetermined pulse width is close to both a first pulse width and a second pulse width differing from the first pulse width, the first pulse width with which the ink speed changes by a small amount when the driving frequency is changed, the second pulse width with which the ink speed changes by a small amount when the head difference is changed.

4. The driving method according to claim 2, wherein the predetermined pulse width is any pulse width between a first pulse width and a second pulse signal width differing from the first pulse width, the first pulse width with which the ink speed changes by a small amount when the driving frequency is changed, the second pulse width with which the ink speed changes by a small amount when the head difference is changed.

5. A drive pulse determining method for determining a drive pulse used foil for an ink jet head including an ink chamber defined by a diaphragm and connected to an ink tank storing ink an orifice plate formed with at least one line of plurality of orifices therein, a piezoelectric element which is attached to the diaphragm and deforms when a drive pulse is applied to the piezoelectric element, thereby varying pressure in the ink chamber) an ink channel for supplying ink to the ink chamber, and a housing formed with a common ink channel in fluid communication with the ink channel, the drive pulse determining method comprising the steps of:

a) measuring, for different pulse widths, change in ink speeds when a head difference between a vertical position of the orifice and a vertical position of the head of the ink in the ink tank is changed; and b) determining one of the different pulse widths, with which an ink speed changes by a small amount when the head difference is changed.

6. The drive pulse determining method according to claim 5, wherein the determined pulse width is a pulse width with which an ink speed changes by a small amount when a driving frequency is changed.

7. The drive pulse determining method according to claim 5, further comprising the steps of:

c) measuring, for the different pulse widths, change in ink speed when a driving frequency is changed; and d) determining one of the different pulse width, with which the ink speed changes by a small amount when the driving frequency is changed;

e) determining a pulse width close to both the pulse widths determined in the steps b) and d) if the pulse width determined in the step b) differs from the pulse width determined in the step d).

8. The drive pulse determining method according to claim 5, further comprising the steps of:

c) measuring, for the different pulse widths, change in ink speed when a driving frequency is changed;

d) determining one of the different pulse width, with which the ink speed changes by a small amount when the driving frequency is changed;

e) determining any pulse width between the pulse widths determined in the steps b) and d) if the pulse width determined in the step b) differs from the pulse width determined in the step d).

9. An ink jet head comprising:

a diaphragm defining an ink chamber that is connected to an ink storing ink;

an orifice plate formed with at least one line of plurality of orifices therein;

a piezoelectric element attached to the diaphragm;

a drive unit that applies a drive pulse to the piezoelectric element, wherein the piezoelectric element deforms the diaphragm when applied with the drive pulse, thereby varying pressure in the ink chamber, and the drive signal has a predetermined pulse width, with which an ink speed changes by a small amount when a head difference between a vertical position of the orifice and a vertical position of the head of the ink in the ink in the ink tank is changed, wherein the drive unit applies the same drive pulse before and after the head difference is changed.

10. The ink jet head according to claim 9, wherein the drive signal has the predetermined pulse width with which an ink speed changes by a small amount when a driving frequency is changed.

11. The ink jet head according to claim 9, wherein the predetermined pulse width is close to both a first pulse width and a second pulse width differing from the first pulse width, the first pulse width with which the ink speed changes by a small amount when the driving frequency is changed, the second pulse width with which the ink speed changes by a small amount when the head difference is changed.

12. The ink jet head according to claim 9, wherein the predetermined pulse width is any pulse width between a first pulse width and a second pulse width differing from the first pulse width, the first pulse width with which the ink speed changes by a small amount when the driving frequency is changed, the second pulse width with which the ink speed changes by a small amount when the head difference is changed.

* * * * *